US006961054B2

(12) United States Patent
Matsumoto

(10) Patent No.: US 6,961,054 B2
(45) Date of Patent: Nov. 1, 2005

(54) DRIVING CIRCUIT AND DISPLAY COMPRISING THE SAME

(75) Inventor: Shoichiro Matsumoto, Ogaki (JP)

(73) Assignee: Sanyo Electric Co., Ltd., Osaka (JP)

( * ) Notice: Subject to any disclaimer, the term of this patent is extended or adjusted under 35 U.S.C. 154(b) by 291 days.

(21) Appl. No.: 10/151,947

(22) Filed: May 22, 2002

(65) Prior Publication Data

US 2002/0175905 A1 Nov. 28, 2002

(30) Foreign Application Priority Data

May 24, 2001 (JP) ..... 2001-155360

(51) Int. Cl.[7] ..... G09G 5/00
(52) U.S. Cl. ..... 345/204; 345/52; 345/87
(58) Field of Search ..... 345/42, 44, 47, 345/50, 51, 52, 87, 99–100, 204, 210–213

(56) References Cited

U.S. PATENT DOCUMENTS

| | | | | |
|---|---|---|---|---|
| 6,049,321 A | * | 4/2000 | Sasaki | 345/99 |
| 6,104,364 A | * | 8/2000 | Hayashi | 345/87 |
| 6,157,360 A | * | 12/2000 | Jeong et al. | 345/98 |
| 6,424,328 B1 | * | 7/2002 | Ino et al. | 345/87 |
| 6,784,866 B2 | * | 8/2004 | Udo et al. | 345/100 |
| 6,816,144 B2 | * | 11/2004 | Tsuchi | 345/100 |

FOREIGN PATENT DOCUMENTS

| | | |
|---|---|---|
| JP | 63-189896 | 8/1988 |
| JP | 7-114362 | 5/1995 |
| JP | 7-261714 | 10/1995 |
| JP | 8-82784 | 3/1996 |
| JP | 9-80382 | 3/1997 |
| JP | 10-105134 | 4/1998 |
| JP | 10-326084 | 12/1998 |
| JP | 11-3068 | 1/1999 |
| JP | 11-119734 | 4/1999 |
| JP | 11-184443 | 7/1999 |
| JP | 11-305744 | 11/1999 |
| JP | 2000-165243 | 6/2000 |
| JP | 2000-322019 A | 11/2000 |
| JP | 2000-338919 | 12/2000 |
| JP | 2001-166750 | 6/2001 |

* cited by examiner

*Primary Examiner*—Henry N. Tran
(74) *Attorney, Agent, or Firm*—McDermott Will & Emery LLP

(57) ABSTRACT

A driving circuit capable of reducing current consumption is obtained. This driving circuit comprises an analog buffer circuit outputting a signal responsive to the potential of input data while supplying the data to a data line and a buffer control circuit for substantially stopping the analog buffer circuit when not supplying the data to the data line. Thus, the operating time of the analog buffer circuit is minimized, whereby current consumption can be reduced.

17 Claims, 10 Drawing Sheets

DRIVING CIRCUIT AND DISPLAY COMPRISING THE SAME

BACKGROUND OF THE INVENTION

1. Field of the Invention

The present invention relates to a driving circuit and a display comprising the same, and more particularly, it relates to a driving circuit supplying data to data lines and a display comprising the same.

2. Description of the Background Art

A driving circuit and a display supplying data to data lines are known in general. In relation to a display such as a liquid crystal display (LCD) or an organic EL (electroluminescence) display receiving a digital video signal, for example, a system converting the digital video signal to an analog video signal for writing the video signal (data) in a data line is known. In the specification, such a display is described with reference to a liquid crystal display (LCD).

Following recent demand for a miniature LCD employing polysilicon TFTs (thin film transistors), reduction of power consumption in a display system including an LCD panel and an external control IC and implementation of a digital interface corresponding to digitization of a peripheral device are highly required. In particular, digitization of a video signal is highly required. In order to digitize the video signal, a DAC (digital-to-analog converter) converting a digital video signal to an analog video signal must be built into the display panel. A liquid crystal display having such a built-in digital-to-analog converter is disclosed in Japanese Patent Laying-Open No. 7-261714 (1995) (first gazette) or Japanese Patent Laying-Open No. 2000-165243 (second gazette), for example.

FIG. 9 is a block diagram showing a liquid crystal display (LCD) according to first prior art disclosed in the aforementioned first gazette. Referring to FIG. 9, the liquid crystal display according to the first prior art comprises a horizontal scanning circuit 101, a vertical scanning circuit 102, a pixel part 103, a digital-to-analog conversion circuit 104 and switches 105. Each pixel forming the pixel part 103 includes a transistor 131, a capacitor 132 and a liquid crystal 133.

In schematic operation, the liquid crystal display according to the first prior art shown in FIG. 9 converts a digital video signal to an analog signal by the digital-to-analog conversion circuit 104, and thereafter directly drives each pixel selected through a horizontal address and a vertical address. This system, writing analog video data every pixel, is referred to as a dot sequential driving system.

However, a video data writing time in the dot sequential driving system depends on the cycle of a horizontal clock (CKH), and hence the video data must be written in a short time. Therefore, the liquid crystal display according to the first prior art shown in FIG. 9 requires high current drivability for the digital-to-analog conversion circuit 104. The current consumed by the digital-to-analog conversion circuit 104 having such high current drivability is disadvantageously increased.

The aforementioned second gazette discloses a liquid crystal display capable of reducing current drivability in a digital-to-analog conversion part by providing the digital-to-analog conversion part with an analog buffer while driving a single data line by the analog buffer and employing a line sequential driving system. FIG. 10 is a block diagram showing the liquid crystal display (LCD) according to second prior art disclosed in the second gazette. Referring to FIG. 10, the liquid crystal display according to the second prior art comprises an analog reference power source 201, a decoder 202, switches SW11, SW12, SW13, . . . , an output buffer (analog buffer) 203 and an analog buffer 204. The analog buffer 204, provided for adjusting an input potential for starting the output buffer 203, is driven with a power supply potential VDD2.

A switch SW1 is provided between the switches SW11 to SW18. A switch SW3 is provided between the analog buffer 204 and the output buffer 203. A parasitic capacitor C1 is connected to a first input terminal of the output buffer 203.

The decoder 202 selects a reference potential input in the output buffer 203 on the basis of digital video data D1, D2 and D3. The analog reference power source 201 resistively divides power supply potentials VDD1 and GND thereby generating the reference potential selected by the decoder 202.

The liquid crystal display according to the second prior art shown in FIG. 10 employs the line sequential driving system dissimilarly to the liquid crystal display according to the first prior art shown in FIG. 9. In the line sequential driving system, red, green or blue data for a single data line connected to a vertical scanning circuit is written in a high-level period of a write signal. The liquid crystal display according to the second prior art shown in FIG. 10 is provided with a single output buffer 203 every data line.

In the liquid crystal display according to the second prior art employing the line sequential driving system shown in FIG. 10, the output buffer (analog buffer) 203 drives a load corresponding to a single data line as described above, whereby currents consumed by the output buffer 203 and the analog buffer 204 can be reduced. Further, a sufficient write time can be ensured due to the line sequential driving system. Thus, precision of written data can also be improved.

However, the liquid crystal display according to the second prior art shown in FIG. 10 is provided with two analog buffers, i.e., the output buffer 203 and the analog buffer 204, every data line. Therefore, the number of the analog buffer circuits is increased in response to the number of the data lines. Thus, currents consumed by the analog buffer circuits are increased as a whole. In particular, through currents regularly flow in the analog buffer circuits in operation generally adjusting potentials to desired levels by current mirror circuits while consuming currents. Thus, current consumption tends to be increased.

Under such circumstances, the liquid crystal display according to the second prior art shown in FIG. 10 regularly operates the output buffer 203, disadvantageously leading to high current consumption. When a through current flows in the output buffer 203 provided every data line, current consumption is also disadvantageously increased.

In the liquid crystal display according to the second prior art shown in FIG. 10, further, the occupation areas of the output buffer 203 and the analog buffer 204 provided every data line are disadvantageously increased. Therefore, an area occupied by a part (frame part) other than a pixel part is increased in a display panel, to disadvantageously increase the area of a frame of the display.

SUMMARY OF THE INVENTION

An object of the present invention is to provide a driving circuit capable of reducing current consumption.

Another object of the present invention is to reduce the occupation area of an analog buffer circuit as well as the number of elements in the aforementioned driving circuit.

Still another object of the present invention is to provide a display, capable of reducing current consumption and the device cost, having a narrow frame.

A driving circuit according to a first aspect of the present invention comprises an analog circuit for outputting a signal responsive to the potential of input data while supplying the data to a data line and a buffer control circuit for substantially powering off the analog buffer circuit when not supplying the data to the data line. Throughout the specification, the term "signal" indicates a potential or a current.

The driving circuit according to the first aspect is provided with the buffer control circuit for substantially powering off the analog buffer circuit when not supplying the data to the data line as described above so that the operating time of the analog buffer circuit can be minimized, whereby current consumption can be reduced.

The aforementioned driving circuit according to the first aspect preferably further comprises a switch for transferring the data output from the analog buffer circuit to the data line and a switch control signal generation circuit for generating a switch control signal controlling the switch, and the buffer control circuit preferably operates the analog buffer circuit in synchronization with the switch control signal. According to this structure, the analog buffer circuit can be readily driven only when supplying the data to the data line. In this case, the switch control signal generation circuit may generate three types of switch control signals corresponding to red, green and blue data respectively.

In the aforementioned driving circuit according to the first aspect, the analog buffer circuit is preferably provided for a plurality of data lines. According to this structure, the occupation area of the analog buffer circuit as well as the number of elements can be reduced as compared with a case of providing the analog circuit every data line. Thus, the device cost as well as the number of simultaneously operating elements can be reduced, whereby current consumption can be reduced. When this driving circuit is applied to a display, for example, for sharing the analog buffer circuit located on a peripheral part (frame part) other than a pixel part with respect to a plurality of data, the occupation area of the frame part can be reduced. Consequently, a display having a narrow frame can be obtained. In this case, the analog buffer circuit may be provided for three data lines of red, green and blue.

The aforementioned driving circuit having the analog buffer circuit provided for a plurality of data lines preferably sequentially transfers the data to the data lines while displacing timings for transferring the data from each other. According to this structure, the data can be readily transferred to the plurality of data lines also when the analog buffer circuit is shared with respect to the plurality of data lines. In this case, the driving circuit preferably sequentially transfers the data to the data lines in a time-divisional manner. According to this structure, the data can be readily transferred to the plurality of data lines.

In the aforementioned driving circuit according to the first aspect, the analog buffer circuit may be provided for a single data line. Also according to this structure, the aforementioned buffer control circuit can minimize the operating time of the analog buffer circuit, whereby current consumption can be reduced.

The aforementioned driving circuit according to the first aspect preferably further comprises an analog reference potential generation circuit for generating a reference potential for analog data input in the analog buffer circuit, and the potential across the analog reference potential is inverted in response to inversion of a counter potential. When such a driving circuit is applied to a display, for example, a pixel part connected to the data line can be readily subjected to counter AC driving. The term "counter AC driving" indicates a data driving system of AC-operating a second electrode (counter electrode) different from a first electrode of a pixel to which a video data signal is applied thereby halving the amplitude of the video data signal. Current consumption can be reduced due to such counter AC driving. In this case, the analog buffer circuit and the buffer control circuit are preferably operated at a potential between positive and negative potentials. According to this structure, the analog buffer circuit can be readily operated also when an analog reference potential smaller than the threshold voltage of an n-channel transistor is input in the analog buffer circuit in counter driving.

In the aforementioned driving circuit according to the first aspect, the analog buffer circuit preferably includes an analog buffer, a p-channel transistor connected between a first power source and the analog buffer, and an n-channel transistor connected between a second power source and the analog buffer. According to this structure, the analog buffer can be readily substantially stopped when not supplying the data to the data line by inputting a signal from the buffer control circuit in the gates of the p-channel and n-channel transistors.

In the aforementioned driving circuit according to the first aspect, the buffer control circuit may include an inverter circuit and a NOR circuit, while the buffer control circuit may alternatively be formed by an inverter circuit.

In the aforementioned driving circuit according to the first aspect, a negative potential is preferably employed as the low-voltage side power source for the analog buffer circuit. According to this structure, an analog buffer circuit capable of generating a reference potential smaller than the threshold voltage of a transistor can be implemented. Thus, the counter AC driving system can be readily employed.

A display according to a second aspect of the present invention a driving circuit and a pixel part connected to a data line, and the driving circuit includes an analog buffer circuit for outputting a signal responsive to the potential of input data while supplying the data to the data line and a buffer control circuit for substantially powering off the analog buffer circuit when not supplying the data to the data line.

The display according to the second aspect is provided with the buffer control circuit for substantially powering off the analog buffer circuit when not supplying the data to the data line as described above so that the operating time of the analog buffer circuit can be minimized, whereby current consumption of the display can be reduced.

In the aforementioned display according to the second aspect, the driving circuit preferably further includes a switch for transferring the data output from the analog buffer circuit to the data line and a switch control signal generation circuit for generating a switch control signal controlling the switch, and the buffer control circuit preferably operates the analog buffer circuit in synchronization with the switch control signal. According to this structure, the analog buffer circuit can be readily operated only when supplying the data to the data line.

In the aforementioned display according to the second aspect, the analog buffer circuit is preferably provided for a plurality of data lines. According to this structure, the occupation area of the analog buffer circuit as well as the number of elements can be reduced as compared with a case of providing the analog circuit every data line. Thus, the device cost as well as the number of simultaneously operating elements can be reduced, whereby current consumption of the display can be reduced. When the analog buffer circuit located on a peripheral part (frame part) other than a pixel part is shared with respect to a plurality of data, the occupation area of the frame part can be reduced. Consequently, a display having a narrow frame can be obtained.

The aforementioned display according to the second aspect preferably sequentially transfers the data to the data lines while displacing timings for transferring the data from each other. According to this structure, the data can be readily transferred to the plurality of data lines also when the analog buffer circuit is shared with respect to the plurality of data lines.

In the aforementioned display according to the second aspect, the driving circuit preferably further includes an analog reference potential generation circuit for generating a reference potential for analog data input in the analog buffer circuit, and the potential across the analog reference potential is preferably inverted in response to inversion of a counter potential. According to this structure, a pixel part connected to the data line can be readily subjected to counter AC driving. Current consumption of the display can be reduced due to such counter AC driving.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention are now described with reference to the drawings.

(First Embodiment)

Figure 1:
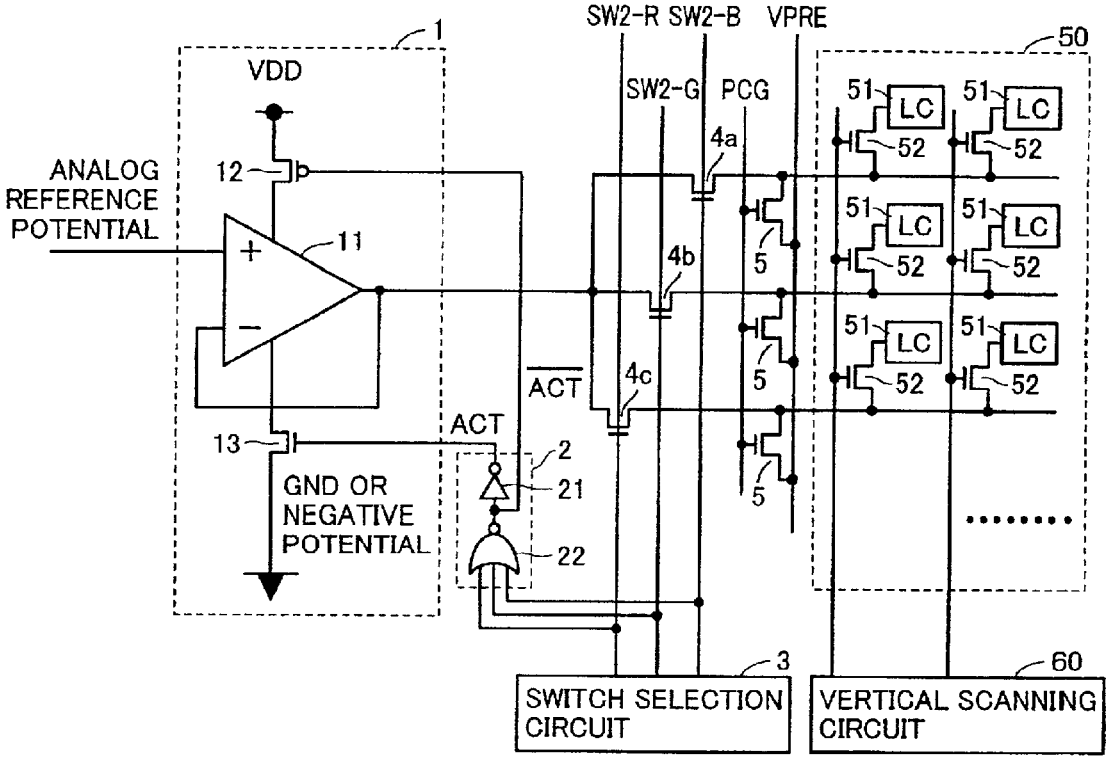
FIG. 1 is a block diagram showing a liquid crystal display according to a first embodiment of the present invention.

Referring to FIG. 1, a liquid crystal display according to a first embodiment of the present invention comprises an analog buffer circuit 1, a buffer control circuit 2, a switch selection circuit 3, switches 4*a*, 4*b* and 4*c*, transistors 5, a pixel part 50 and a vertical scanning circuit 60. Each pixel forming the pixel part 50 includes a liquid crystal 51 and a transistor 52. The switch selection circuit 3 is an example of the "switch control signal generation circuit" according to the present invention.

According to the first embodiment, start signals ACT and /ACT from the buffer control circuit 2 are activated only when any of switch selection signals SW2-R, SW2-G and SW2-B generated by the switch selection circuit 3 enters an ON state, thereby operating the analog buffer circuit 1. In other words, the liquid crystal display according to the first embodiment operates the analog buffer circuit 1 in synchronization with write control signals (switch control signals) SW2-R, SW2-G and SW2-B.

According to the first embodiment, the analog buffer circuit 1 includes an analog buffer 11, a p-channel transistor 12 arranged between a power supply voltage VDD and the analog buffer 11, and an n-channel transistor 13 arranged between a ground potential GND or a negative potential and the analog buffer 11. The buffer control circuit 2 includes an inverter circuit 21 and a NOR circuit 22.

In operation, the analog buffer circuit 1 outputs a potential responsive to an analog reference potential and supplies the output data to a data line connected to the switch 4*a*, 4*b* or 4*c* turned on by any of the write control signals SW2-R, SW2-G and SW2-B. When the switch selection circuit 3 activates no write control signal SW2 (SW2-R, SW2-G or SW2-B), low-level signals are input in the NOR circuit 22 of the buffer control circuit 2 and hence an output of the NOR circuit 22 goes high while that of the inverter circuit 21 goes low. Thus, the p-channel transistor 12 and the n-channel transistor 13 are in OFF states. The analog buffer circuit 1 does not operate in this state.

When the switch selection circuit 3 activates any of the write control signals SW2-R, SW2-G and SW2-B in this state, one of inputs of the NOR circuit 22 goes high and hence the output of the NOR circuit 22 goes low while that of the inverter circuit 21 goes high. Thus, the start signals ACT and /ACT go high and low respectively, thereby turning on the n-channel transistor 13 as well as the p-channel transistor 12. Consequently, the analog buffer circuit 1 is started.

The analog buffer circuit 1 writes data in the data line through the switch 4*a*, 4*b* or 4*c*. When the write control signal SW2 (SW2-R, SW2-G or SW2-B) is inactivated, the start signals ACT and /ACT received from the buffer control circuit 2 are also inactivated (low and high respectively), thereby terminating the operation of the analog buffer circuit 1.

According to the first embodiment, the buffer control circuit 2 operating the analog buffer circuit 1 in synchronization with the write control signal SW2 is so provided that the operating time of the analog buffer circuit 1 can be minimized. Thus, current consumption of the analog buffer circuit 1 can be reduced.

Figure 2:
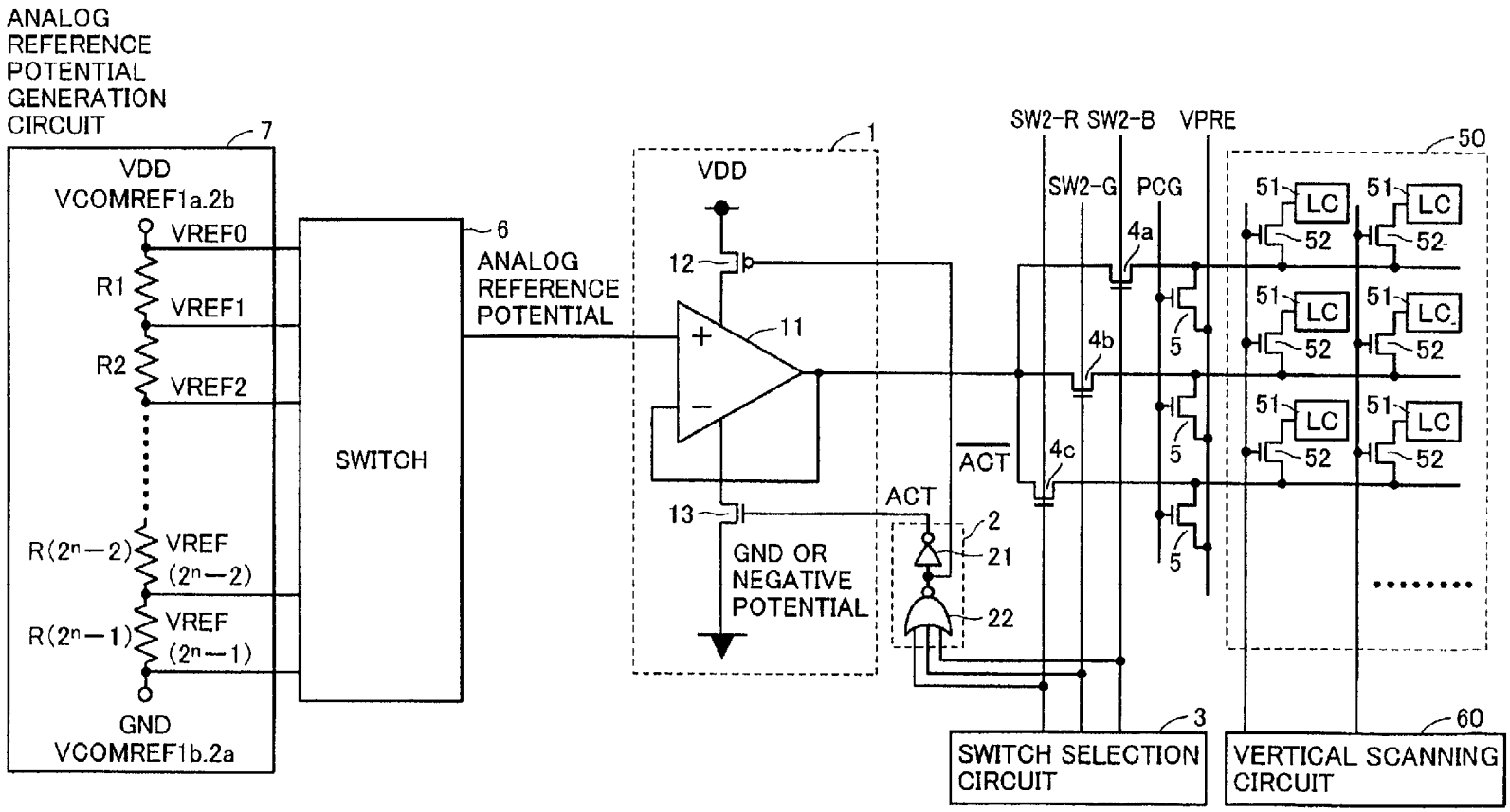
FIG. 2 is a block diagram showing a liquid crystal display according to a first modification of the first embodiment shown in FIG. 1.
Figure 3:
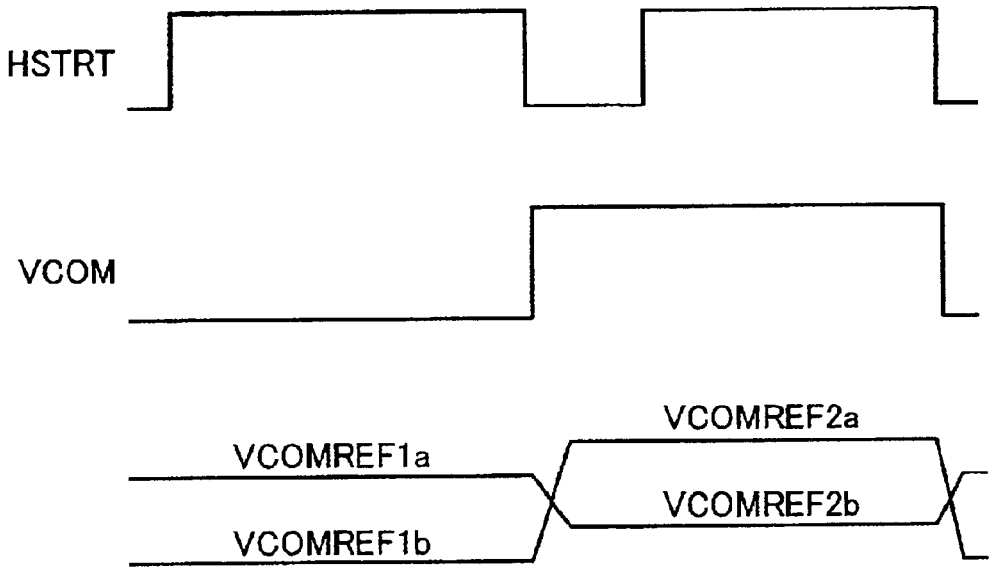
FIG. 3 is a waveform diagram for illustrating operation of generating an analog reference potential employed for counter AC driving of the liquid crystal display according to the first modification of the first embodiment shown in FIG. 2.

FIG. 2 is a block diagram showing a first modification of the liquid crystal display according to the first embodiment shown in FIG. 1, and FIG. 3 is a waveform diagram for illustrating operation of generating an analog reference potential employed for counter AC driving of the liquid crystal display according to the first modification shown in FIG. 2. Referring to FIG. 2, an analog reference potential corresponding to counter AC driving for AC-driving a counter electrode of a liquid crystal 51 is employed as that input in the analog buffer circuit 1 shown in FIG. 1. More specifically, an analog reference potential generation circuit 7 is provided in the first modification for generating such an analog reference potential. The analog reference potential generated by the analog reference potential generation circuit 7 is input in the analog buffer circuit 1 through a switch 6.

The term "counter AC driving system" indicates a driving system capable of reducing the voltage range of a video signal by AC-driving the counter electrode of the liquid crystal 51.

As shown in FIGS. 2 and 3, the analog reference potential generation circuit 7 inverts the potential across divided resistors (VCOMREF1*a*–VCOMREF1*b*→VCOMREF2*b*–VCOMREF2*a*) in response to inversion of a counter potential VCOM, for generating analog video data. Thus, the analog reference potential corresponding to counter AC driving of the liquid crystal 51 can be generated. The analog reference potential corresponding to such counter AC driving is lower than a general analog reference potential, whereby power consumption can be reduced. In this case, the minimum analog reference potential (video signal) is smaller than the threshold voltage of an n-channel transistor 13. Therefore, a negative potential must be employed for a lower potential of the analog buffer circuit 1. Thus, a buffer circuit 2 controlling the analog buffer circuit 1 must also operate with the power supply voltage VDD–negative potential.

The analog buffer circuit 1 capable of generating a reference potential smaller than the threshold voltage of the transistor 13 can be implemented by employing a negative potential as a lower voltage power source for the analog buffer circuit 1, whereby the counter AC driving system can be readily applied to the liquid crystal 51.

Each of the liquid crystal displays according to the first embodiment shown in FIG. 1 and the first modification of the first embodiment shown in FIG. 2 shares the single analog buffer circuit 1 with respect to three data lines of red (R), green (G) and blue (B). Therefore, the occupation area of the analog buffer circuit 1 as well as the number of elements can be reduced as compared with a case of providing an analog buffer circuit every data line. Thus, the device cost as well as the number of simultaneously operating elements can be reduced, whereby current consumption can be reduced. The analog buffer circuit 1 located on a peripheral part (frame part) other than the pixel part (display part) 50 is shared with respect to the three data lines, whereby the occupation area of the frame part can be reduced. Consequently, a display having a narrow frame can be obtained extremely effectively for a miniature display.

Figure 4:
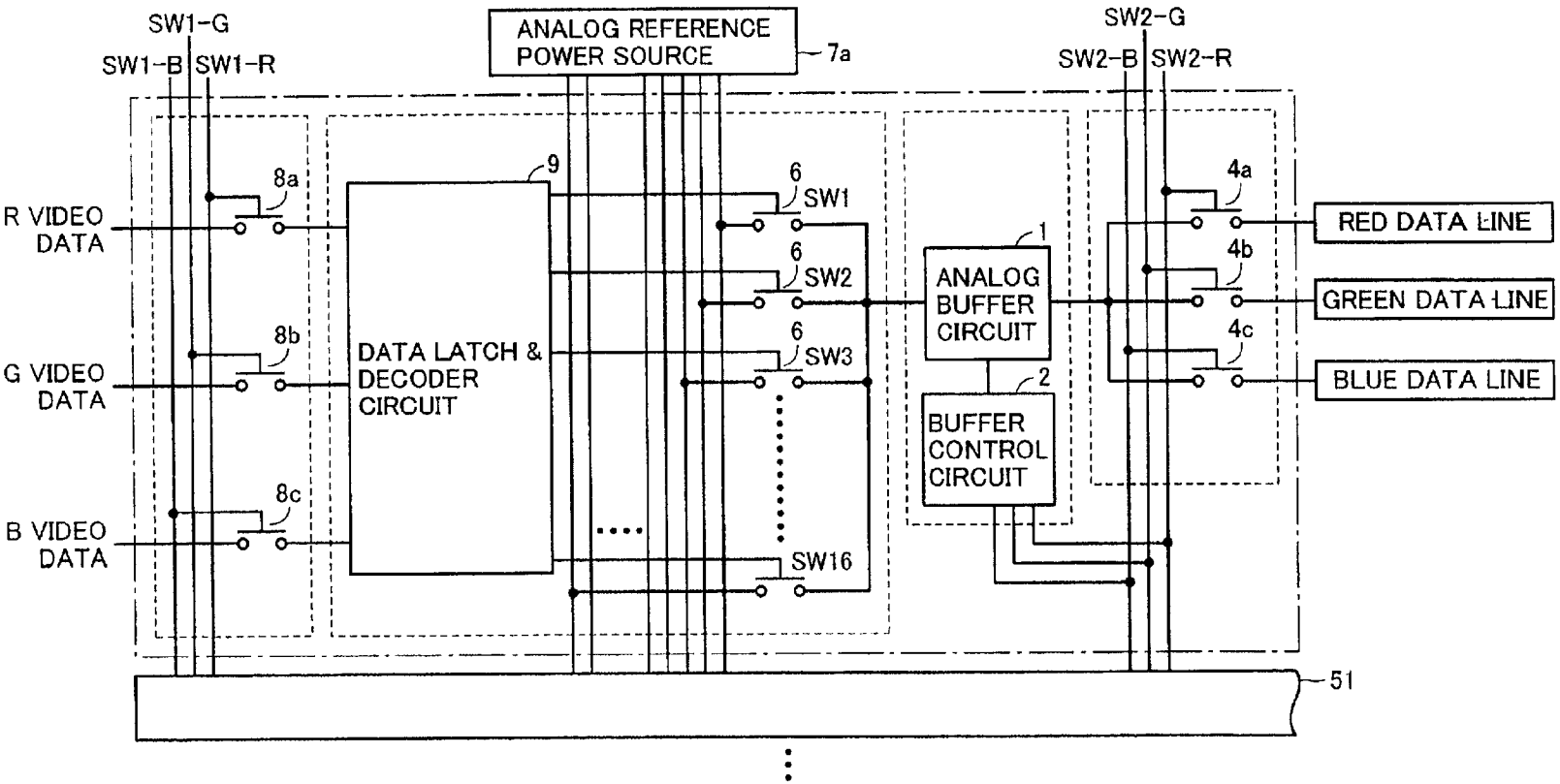
FIG. 4 is a block diagram showing a liquid crystal display according to a second modification of the first embodiment of the present invention.

FIG. 4 is a block diagram showing a liquid crystal display according to a second modification of the first embodiment shown in FIG. 1. Referring to FIG. 4, the liquid crystal display corresponds to four-bit gray levels in the second modification. The liquid crystal display according to the second modification comprises switches 8*a*, 8*b* and 8*c* sequentially turned on by data transfer signals SW1-R, SW1-G and SW1-B and a data latch and decoder circuit 9 receiving transferred data when the switches 8*a* to 8*c* are ON. An analog reference power source 7*a* supplies 16 stages of potentials to 16 lines.

One of switches SW1 to SW16 enters an ON state on the basis of data output from the data latch and decoder circuit 9. Thus, a prescribed analog reference potential is input in an analog buffer circuit 1. The analog buffer circuit 1 and a buffer control circuit 2 are similar in internal structure to those shown in FIG. 1.

Figure 5:
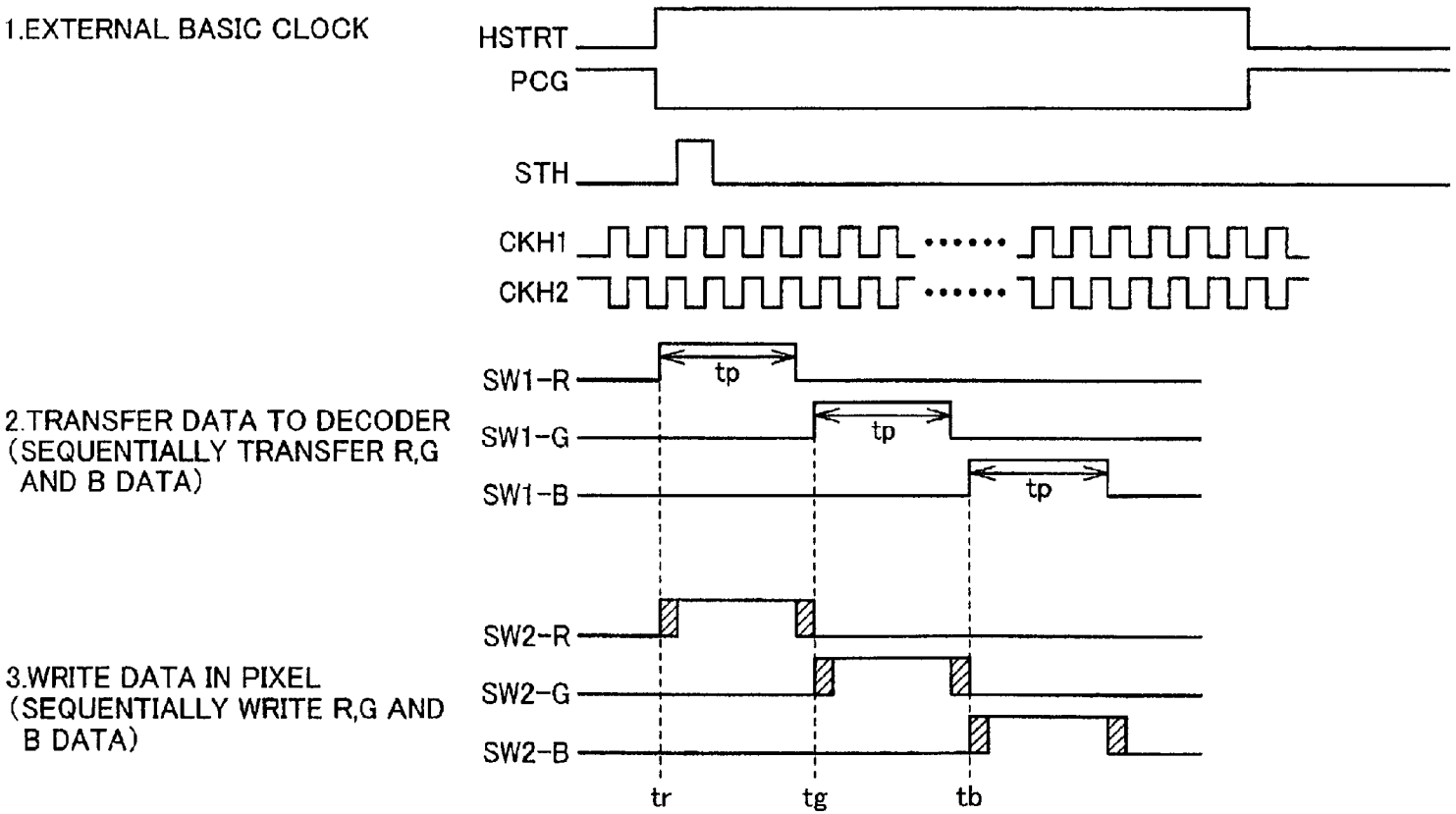
FIG. 5 is an operation waveform diagram for illustrating operation of the liquid crystal display according to the first embodiment, the first modification or the second modification shown in FIG. 1, 2 or 4.

FIG. 5 is an operation waveform diagram for illustrating operation of the liquid crystal display according to the second modification shown in FIG. 4. The operation of the liquid crystal display according to the second modification of the first embodiment is now described with reference to FIGS. 4 and 5. The operation of the liquid crystal display according to the second modification is basically similar to those of the liquid crystal displays according to the first embodiment and the first modification of the first embodiment shown in FIG. 1 and FIG. 2 respectively.

According to the first embodiment or the first or second modification thereof, video data is captured or written in a high-level period of a signal HSTRT. Such a system sequentially capturing video data in a high-level period of the signal HSTRT while simultaneously writing video data in a subsequent high-level period of the signal HSTRT is referred to as a line sequential driving system.

The liquid crystal display shown in FIG. 1, 2 or 4 provided with the analog buffer circuit 1 for the three data lines of red (R), green (G) and blue (B) employs a time-division system for writing data in the data lines. In other words, the liquid crystal display divides the high-level period of the signal HSTRT into three, for writing R, G and B data. A signal STH, indicating initiation of the high-level period (activated or horizontal period) of the signal HSTRT, serves as the reference for generating a video data capture or write signal.

First, the signal HSTRT allowing capturing of video data and starting of display goes high (active), whereby a signal PCG indicating a precharged state (inactive state) goes low. Thus, the transfer signals SW1-R, SW1-G and SW1-B are sequentially activated, thereby sequentially turning on the switches 8*a*, 8*b* and 8*c*. Thus, the R, G and B data are sequentially transferred to the data latch and decoder circuit 9. A decoder specifies an analog reference potential corresponding to the data transferred to the data latch and decoder circuit 9, while an analog data signal corresponding to the specified analog reference potential is input in the analog buffer circuit 1 through any of the switches SW1 to SW16.

The data write signals SW2-R, SW2-G and SW2-B are sequentially activated thereby sequentially turning on the switches 4*a*, 4*b* and 4*c* while starting the analog buffer circuit 1 through the buffer control circuit 2. Thus, the R, G and B data are sequentially written in the data lines.

As understood from FIG. 5, the data transfer signals SW1 and the data write signals SW2 start from times tr (for transferring red data and writing the same in the data line), tg (for transferring green data and writing the same in the data line) and tb (for transferring blue data and writing the same in the data line) respectively in an active period. Symbol tp indicates a data transfer time, and the time for writing the data in the data line is smaller than the data transfer time tp. The write time for the data write signals SW2 shown in FIG. 5 is changeable between hatched regions. In other words, the data write time is preferably smaller than the data transfer time tp, while the data write signals SW2 preferably rise simultaneously with or slower than the data transfer signals SW1 and fall simultaneously with or earlier than the data transfer signals SW1.

(Second Embodiment)

Figure 6:
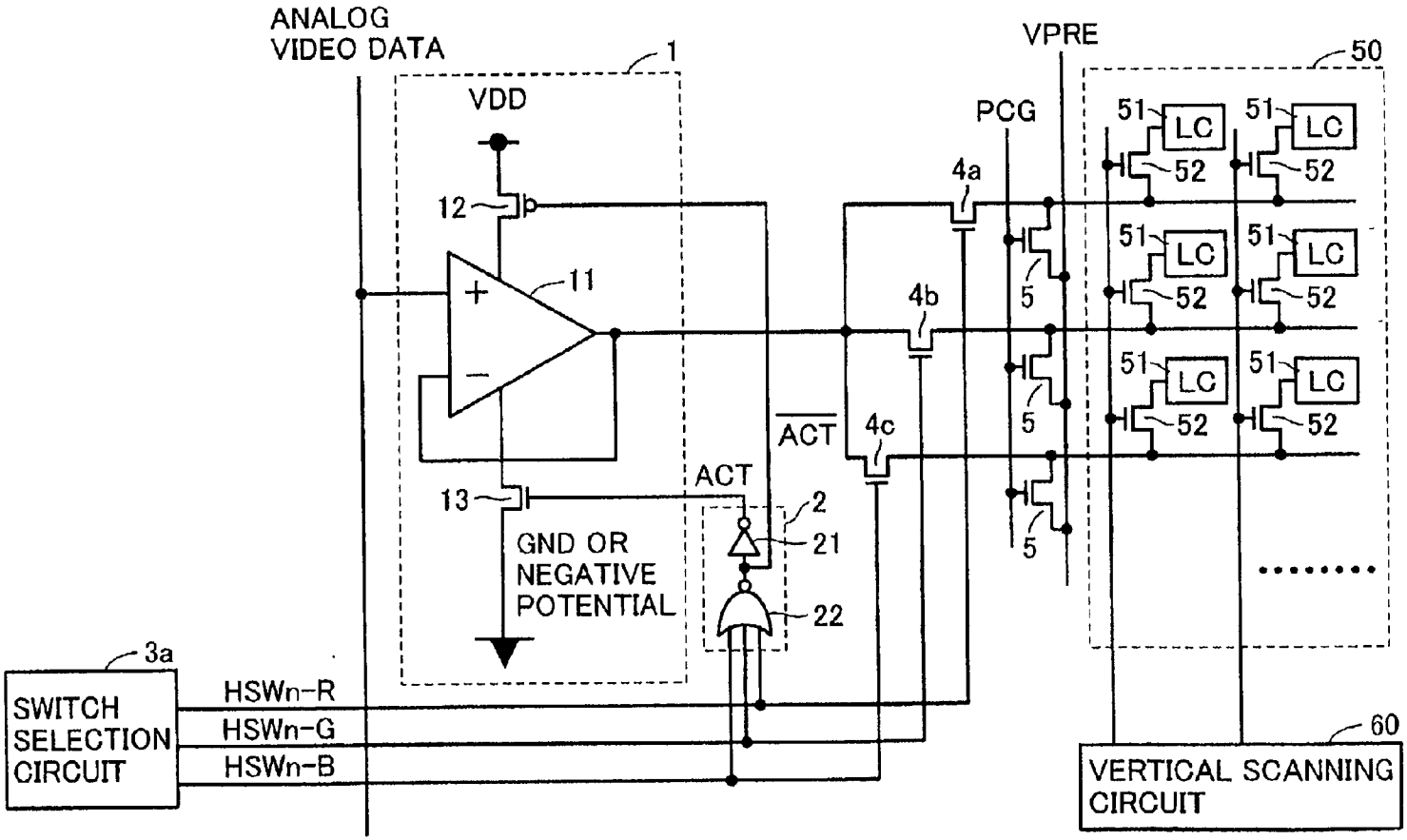
FIG. 6 is a block diagram showing a liquid crystal display according to a second embodiment of the present invention.

FIG. 6 shows the structures of an analog buffer circuit 1 and a buffer control circuit 2 in a liquid crystal display according to a second embodiment of the present invention employing a dot sequential driving system dissimilarly to the aforementioned first embodiment.

According to the second embodiment, a switch selection circuit 3*a* is provided for generating write signals HSWn-R, HSWn-G and HSWn-B for writing video data every pixel in the dot sequential driving system. The switch selection circuit 3*a* is an example of the "switch control signal generation circuit" according to the present invention. The analog buffer circuit 1 operates in synchronization with the write signals HSW generated by the switch selection circuit 3*a*. In other words, the analog buffer circuit 1 operates only when writing data.

Figure 7:
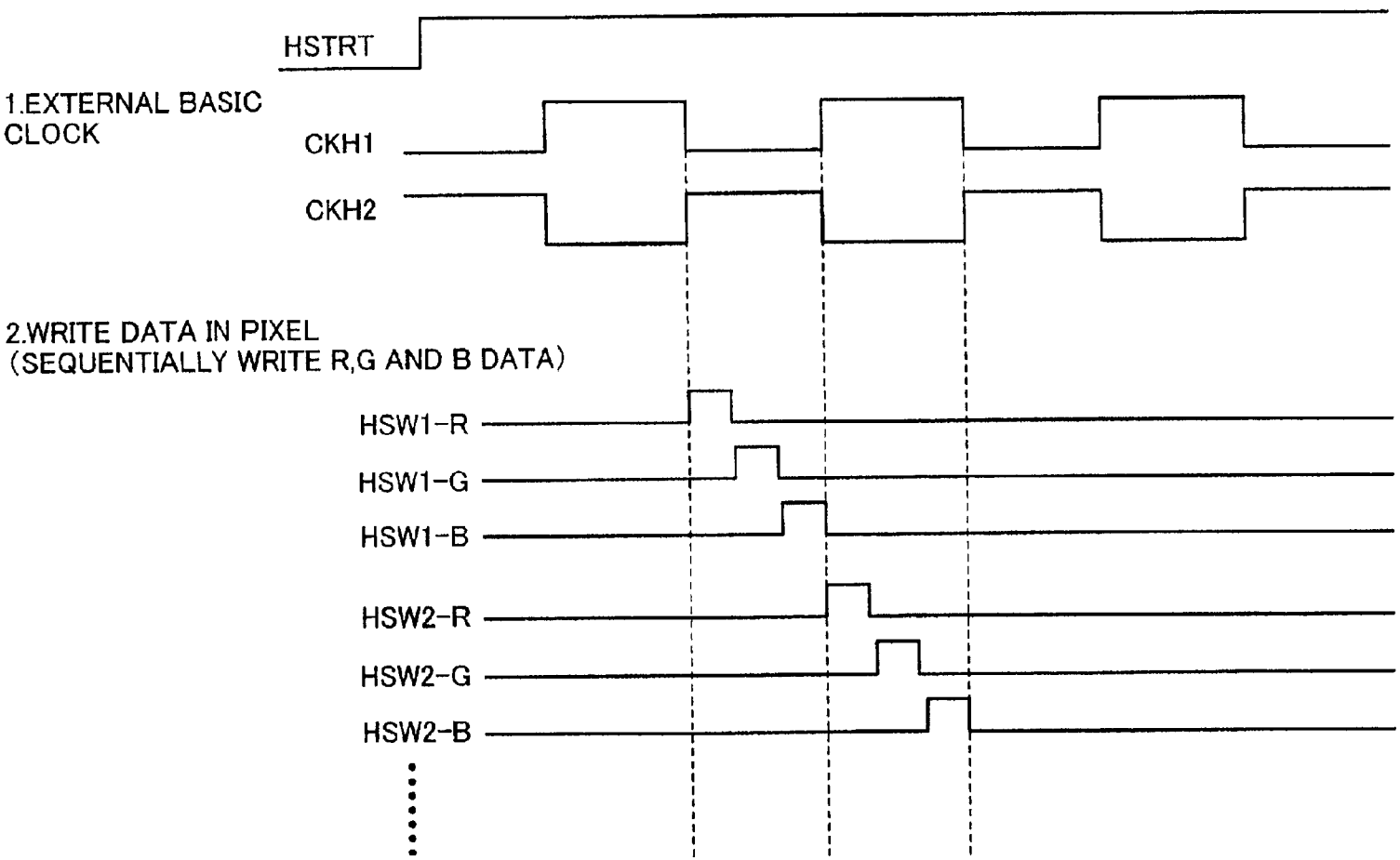
FIG. 7 is an operation waveform diagram for illustrating operation of the liquid crystal display according to the second embodiment shown in FIG. 6.

Data write operation in the liquid crystal display according to the second embodiment employing the dot sequential driving system is now described with reference to FIGS. 6 and 7. In the dot sequential driving system, the liquid crystal display according to the second embodiment sequentially writes three data of red (R), green (G) and blue (B) on the basis of write signals HSW1-R, HSW1-G and HSW1-B in a high-level period of an external basic clock CKH while sequentially writing three data of red (R), green (G) and blue (B) on the basis of write signals HSW2-R, HSW2-G and HSW2-B in a high-level period of an external basic clock CKH2. Therefore, the write time is reduced as compared with the line sequential driving system.

Also according to the second embodiment, the buffer control circuit 2 for substantially powering off the analog buffer circuit 1 when not writing data in data lines is so provided that the operating time of the analog buffer circuit 1 can be minimized similarly to the aforementioned first embodiment, whereby current consumption can be reduced. As described above and with reference to FIG. 1. the analog buffer circuit 1 may be powered off depending on the states of the p-channel transistor 12 and/or the n-channel transistor 13.

The analog buffer circuit 1 is provided for three data lines, whereby the occupation area of the analog buffer circuit 1 as well as the number of elements can be reduced as compared with a case of providing the analog buffer circuit 1 every data line. Thus, the device cost as well as the number of simultaneously operating elements can be reduced, whereby current consumption can be reduced.

Further, the analog buffer circuit 1 located on a peripheral part (frame part) other than a pixel part 50 is shared with respect to three data lines of red (R), green (G) and blue (B), whereby the occupation area of the frame part can be reduced. Consequently, a display having a narrow frame can be obtained particularly effectively for a miniature display.

Also when data are sequentially transferred in a time-divisional manner thereby sharing the analog buffer circuit 1 with respect to the three data lines, the data can readily be transferred.

(Third Embodiment)

Figure 8:
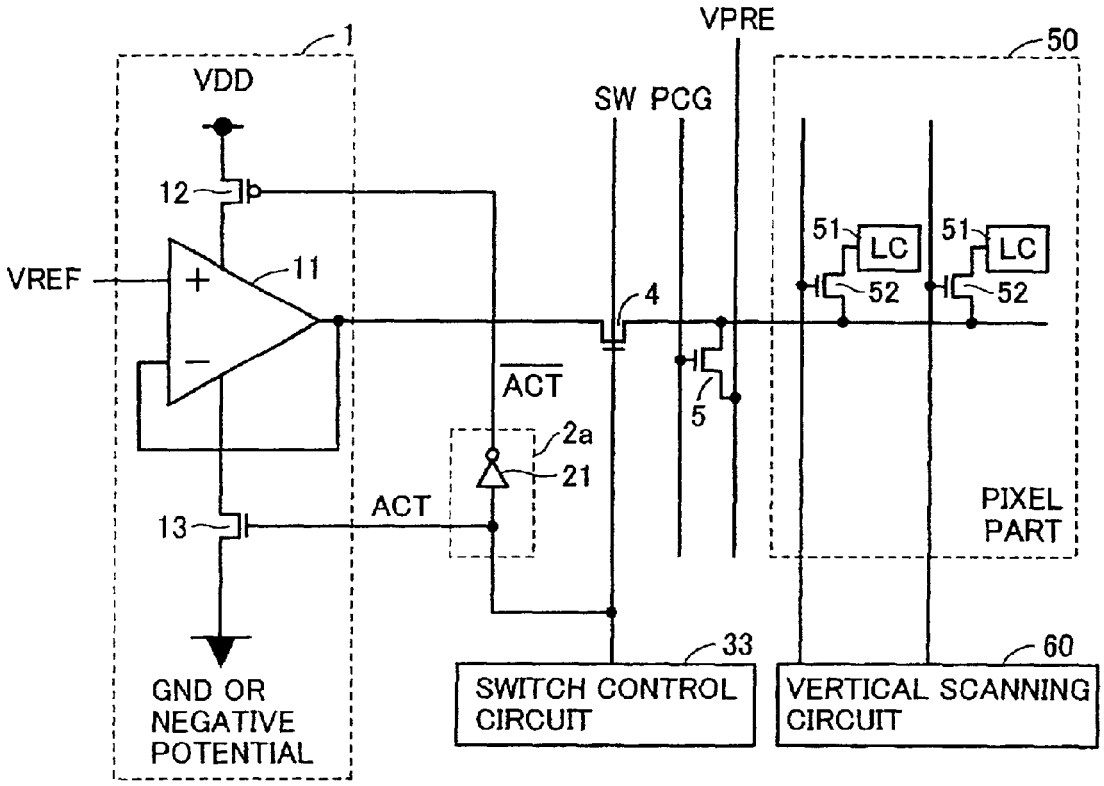
FIG. 8 is a block diagram showing a liquid crystal display according to a third embodiment of the present invention.
Figure 9:
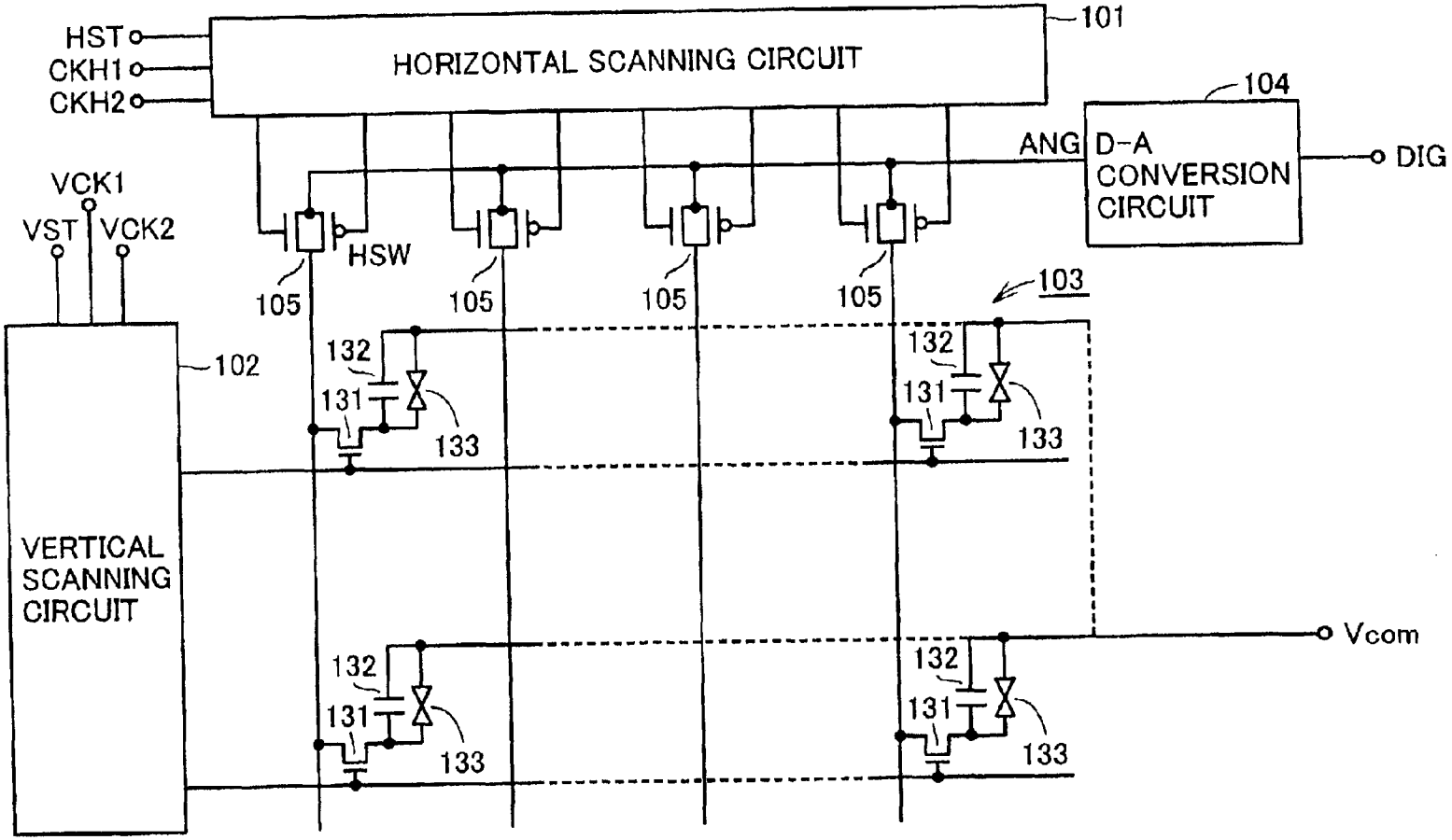
FIG.9 PRIOR ART
FIG. 9 is a block diagram showing a liquid crystal display according to first prior art.
Figure 10:
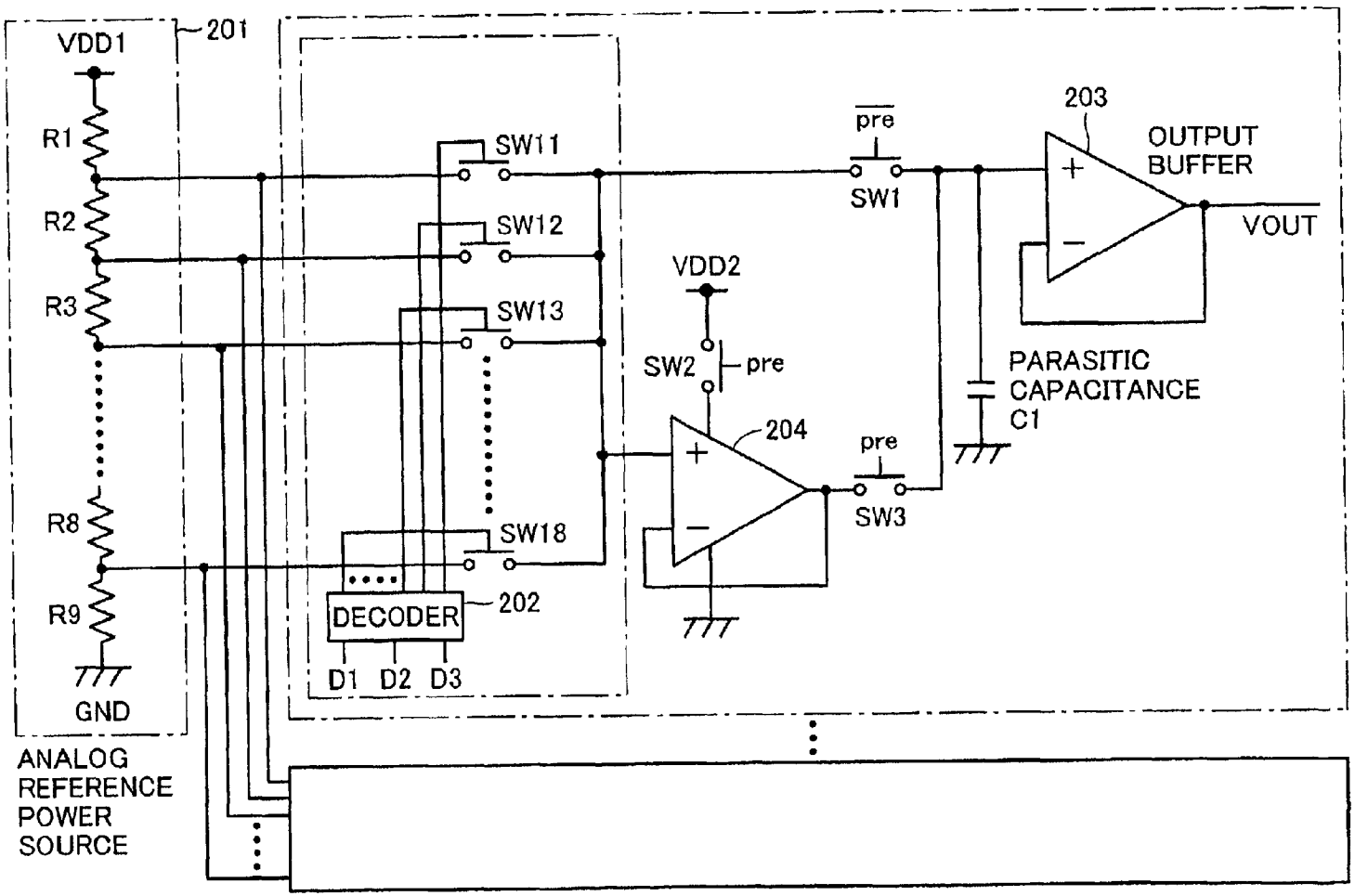
FIG.10 PRIOR ART
FIG. 10 is a block diagram showing a liquid crystal display according to second prior art.

Referring to FIG. 8, an analog buffer circuit 1 is provided every data line in a liquid crystal display according to a third embodiment, dissimilarly to the aforementioned first and second embodiments. When a write signal SW generated by a switch control circuit 33 goes high in this case, a switch 4 is turned on while an n-channel transistor 13 and a p-channel transistor 12 are turned on by start signals ACT and /ACT output from a buffer control circuit 2*a*, thereby activating the analog buffer circuit 1. According to the third embodiment, the buffer control circuit 2*a* is formed by only an inverter circuit 21, dissimilarly to the buffer control circuits 2 according to the aforementioned first and second embodiments. The switch control circuit 33 is an example of the "switch control signal generation circuit" according to the present invention.

According to the third embodiment, the buffer control circuit 2*a* for substantially powering off the analog buffer circuit 1 when not writing data in the data line is so provided that the operating time of the analog buffer circuit 1 can be minimized similarly to the first and second embodiments, whereby current consumption can be reduced.

Although the present invention has been described and illustrated in detail, it is clearly understood that the same is by way of illustration and example only and is not to be taken by way of limitation, the spirit and scope of the present invention being limited only by the terms of the appended claims.

While each of the above embodiments has been described with reference to a display consisting of a liquid crystal display (LCD), for example, the present invention is not restricted to this but is also applicable to another display such as an EL display. The present invention is further applicable to a miniature display such as a portable telephone.

What is claimed is:

1. A driving circuit comprising:

an analog buffer circuit for outputting a signal responsive to the potential of input data while supplying said signal to a data line, wherein said analog buffer circuit is provided for a plurality of said data lines; and a buffer control circuit for substantially powering off said analog buffer circuit when not supplying said signal to said data line.

2. The driving circuit according to claim 1, further comprising:

a switch for transferring said data output from said analog buffer circuit to said data line, and a switch control signal generation circuit for generating a switch control signal controlling said switch, wherein said buffer control circuit operates said analog buffer circuit in synchronization with said switch control signal.

3. The driving circuit according to claim 2, wherein said switch control signal generation circuit generates three types of switch control signals corresponding to red, green and blue data respectively.

4. The driving circuit according to claim 1, wherein a negative potential is employed as the low-voltage side power source for said analog buffer circuit.

5. The driving circuit according to claim 1, wherein said analog buffer circuit is provided for three said data lines of red, green and blue.

6. The driving circuit according to claim 1, sequentially transferring said data to said data lines while displacing timings for transferring said data from each other.

7. The driving circuit according to claim 6, sequentially transferring said data to said data lines in a time-divisional manner.

8. The driving circuit according to claim 1, wherein said analog buffer circuit is provided for single said data line.

9. The driving circuit according to claim 1, further comprising an analog reference potential generation circuit for generating a reference potential for analog data input in said analog buffer circuit, wherein the potential across of said reference potential is inverted in response to inversion of a counter potential.

10. The driving circuit according to claim 9, wherein said analog buffer circuit and said buffer control circuit are operated at a potential between positive and negative potentials.

11. The driving circuit according to claim 1, wherein said analog buffer circuit includes:

an analog buffer, a p-channel transistor connected between a first power source and said analog buffer, and an n-channel transistor connected between a second power source and said analog buffer.

12. The driving circuit according to claim 1, wherein said buffer control circuit includes an inverter circuit and a NOR circuit.

13. The driving circuit according to claim 1, wherein said buffer control circuit is formed by an inverter circuit.

14. A display comprising a driving circuit and a pixel part connected to a data line, wherein said driving circuit includes:

an analog buffer circuit for outputting a signal responsive to the potential of input data while supplying said signal to said data line, said analog buffer circuit is provided for a plurality of said data lines; and a buffer control circuit for substantially powering off said analog buffer circuit when not supplying said signal to said data line.

15. The display according to claim 14, wherein said driving circuit further includes:

a switch for transferring said data output from said analog buffer circuit to said data line, and a switch control signal generation circuit for generating a switch control signal controlling said switch, and said buffer control circuit operates said analog buffer circuit in synchronization with said switch control signal.

16. The display according to claim 14, sequentially transferring said data to said data lines while displacing timings for transferring said data from each other.

17. The display according to claim 14, wherein said driving circuit further includes an analog reference potential generation circuit for generating a reference potential for analog data input in said analog buffer circuit, and the potential across of said reference potential is inverted in response to inversion of a counter potential.

* * * * *